United States Patent [19]

Blotenberg

[11] Patent Number: 4,560,319

[45] Date of Patent: Dec. 24, 1985

[54] METHOD AND APPARATUS FOR CONTROLLING AT LEAST TWO PARALLEL-CONNECTED TURBOCOMPRESSORS

[75] Inventor: Wilfried Blotenberg, Oberhausen, Fed. Rep. of Germany

[73] Assignee: MAN Maschinenfabrik Unternehmensbereich GHH Sterkrade, Oberhausen, Fed. Rep. of Germany

[21] Appl. No.: 519,097

[22] Filed: Aug. 1, 1983

[51] Int. Cl.[4] ..... F04D 27/02

[52] U.S. Cl. ..... 415/1; 415/26; 415/27; 417/286; 417/295

[58] Field of Search ..... 60/612; 417/295, 282, 417/286; 415/1, 26, 27, 28, 17, 50

[56] References Cited

U.S. PATENT DOCUMENTS

| | | | |
|---|---|---|---|
| 2,993,640 | 7/1961 | Moreillon | 415/26 |
| 4,139,328 | 2/1979 | Kuper | 415/1 |
| 4,298,310 | 11/1981 | Blotenberg | 415/1 |
| 4,384,818 | 5/1983 | Blotenberg | 415/1 |

FOREIGN PATENT DOCUMENTS

| | | | |
|---|---|---|---|
| 567849 | 8/1977 | U.S.S.R. | 415/27 |
| 727874 | 4/1980 | U.S.S.R. | 415/26 |

*Primary Examiner*—Douglas Hart
*Attorney, Agent, or Firm*—Felfe & Lynch

[57] ABSTRACT

A method and apparatus for operating parallel connected turbocompressors jointly controls their operation such that each operates at the same percentage of its capacity, i.e. such that the spacing of the operating point of each from its blowoff line which is parallel to its pumping limit is the same.

13 Claims, 10 Drawing Figures

METHOD AND APPARATUS FOR CONTROLLING AT LEAST TWO PARALLEL-CONNECTED TURBOCOMPRESSORS

The invention relates to a method and apparatus for operating at least two parallel-connected turbocompressors, and, more particularly, a method and apparatus in which each turbocompressor is equipped with a pumping-limit controller which opens blowoff or blowdown valves before the pumping limit is reached and as a blowoff line extending parallel to the pumping limit is reached and a pressure controller, and the turbocompressors are further controlled jointly by a load-distribution controller.

With parallel-operated compressors, it is frequently necessary to distribute the load uniformly among all the compressor machines. Usually this requirement is met by associating a flow controller with each machine. The flow controllers are preset by a common, overriding pressure controller.

The pressure controller sets each flow controller to the same, desired value. This, therefore, leads each turbocompressor machine to operate at the same flow rate as the parallel-connected machine or machines. When the machines have different operating characteristics, however, it is possible in this arrangement for one machine to reach the blowoff or blowdown mode while another is still well within its operating capability, and this is a drawback. This is especially likely to happen with machines that have a flat operating characteristic.

This arrangement has the further disadvantage that the flow controller operates in cascade with the pressure controller.

Since sustained deviations must be avoided, the two controllers have to be constructed as PI (proportional-integral) controllers. It is known that a series circuit of two PI controllers is stable in operation only when the primary controller is considerably slower-acting than the secondary controller. Since turbocompressors usually are also provided with pumping-limit controllers which likewise have proportional-plus-integral action, these three then determine the transient response of the entire control system.

In practice, the pumping-limit controller usually is adjusted first for stability. The flow controller then has to respond much more slowly to avoid instability. The pressure controller, as the overriding master control, then, in turn, must respond still much more slowly. As a result, the pressure controller can compensate for pressure disturbances only rather slowly. It is, however, the function of the controllers to prevent operating conditions under which one machine blows off while any of the other machines is operating well within its characteristic performance curves. A control designed to establish uniform flow rates cannot fully perform this function. For example, asymmetries in the shapes of the characteristic curves or of the blowoff lines, as described above, the influence of different suction pressures or asymmetric flow in the pipe lines cannot be compensated for.

The invention thus seeks to provide a method of operating or controlling parallel-connected turbocompressors which is not afflicted with the drawbacks mentioned and which, in particular, permits all turbocompressors to be operated at an adequate distance from the blowoff line so that needless blowing off is reliably prevented while maximum security with respect to pumping (i.e., varying pressure as the system hunts for stable operation) is provided.

The invention should make possible operating all the turbocompressors under optimum conditions and adjusting them quickly to any pressure and flow-rate variations, and the entire control system should be reliable, not susceptible to malfunctioning, and economical. In particular, it should make possible implementing the entire control system with commercial components.

Moreover, these objectives should be attained with the novel desideratum in mind that blowing off or pumping by individual compressors is to be avoided in particular as it could create, for example, objectionable noise, efficiency losses of considerable magnitude, and possibly also damage.

In accordance with the invention, this object is accomplished, in the method mentioned at the outset, in that the load distribution controllers control the adjustment of the individual compressors in such a way that the spacing of the operating point from the blowoff line is the same for each of them.

For particularly rapid adjustment to changes in conditions, it is advantageous that only one of the compressors be controlled by its pressure controller and the others are slaved to the load-distribution controlling means. In this way, assurance is further provided that the spacing between the operating point and the blowoff line is optimum.

An exemplary embodiment of the invention will now be described in greater detail with reference to the drawings, wherein.

Figure 1:
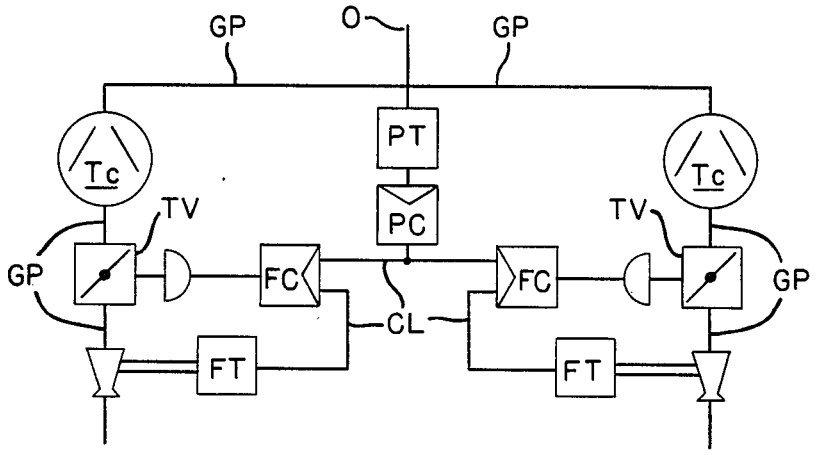
FIG. 1 shows a conventional prior-art cascade control circuit.

For comparison with the invention, FIG. 1 shows the prior art cascade control of parallel-connected turbocompressors described above. A pair of turbocompressors TC are connected to move gas along parallel paths GP to a common outlet 0. A gas flow transducer FT at the inlet to the gas path GP to each turbocompressor transduces one control signal onto control lines CL for a respective flow controller FC which operates a throttle valve TV in the gas path GP of each turbocompressor. A pressure transducer PT connected to the common outlet 0 of the gas paths of the parallel-connected turbocompressors transducers a second control signal which, through a pressure controller PC, is also supplied to each flow controller to complete the known cascade control arrangement.

Figure 2:
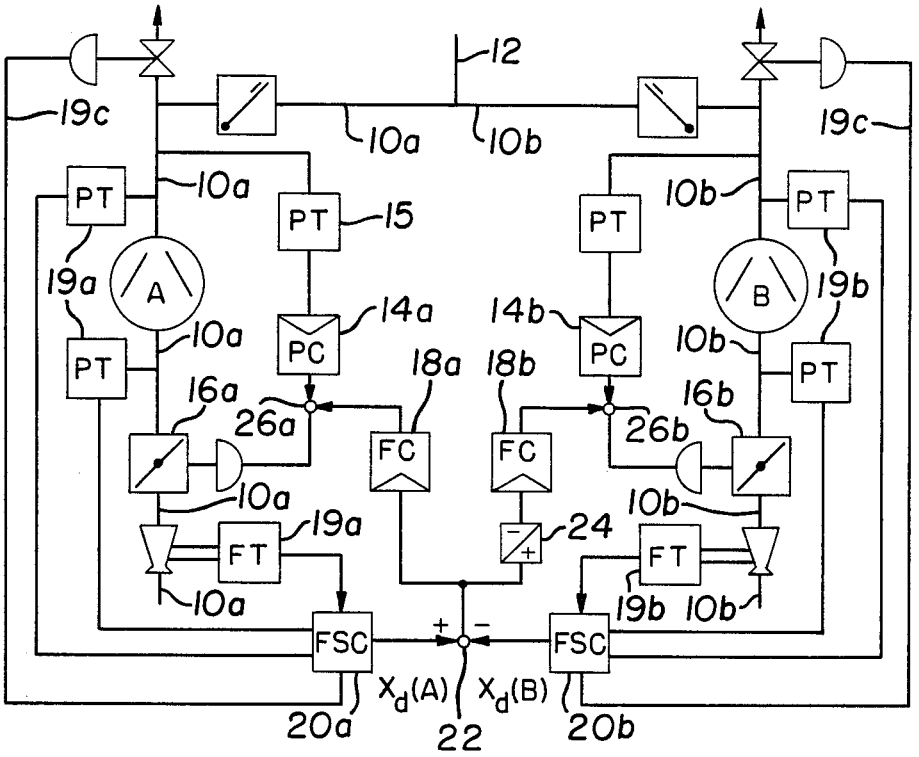
FIG. 2 shows a load-distribution control circuit in accordance with the invention.

According to the invention as shown in FIG. 2, each of two turbocompressors A, B which are parallel-connected along gas paths 10a, 10b to a common outlet 12 has its own pressure controller 14a, 14b which acts directly on a respective throttle valve 16a, 16b. The transient response of the pressure controllers 14a, 14b thus can be made as rapid as that of the flow-controller in the known system of FIG. 1.

Only one pressure controller 14a can be adjusted in automatic operation by a pressure transducer 15. The other 14b (or others in an embodiment having more than two parallel-connected turbocompressors) is set manually; in other words, pressure controller 14b is passive so long as there is no manual intervention.

Load distribution is accomplished through parallel load-distribution controllers (FC) 18a, 18b. As an essential characteristic of the invention, however, the actual values fed to these controllers are not the flow rate but the spacing of the operating point of the machine from the blowoff line (measured in the pressure/flow-rate diagram).

This quantity is identical with the deviation $x_d$ of pumping-limit controllers (FSC) 20a, 20b from flow and pressure transducers 19a, 19b which also provide blowoff control over lines 19c and is available from them as a signal which therefore does not need to be identified or measured separately. How such signal is identified is apparent from German patent application No. P 26 23 899.3 and corresponding Kuper et al. U.S. Pat. No. 4,139,328 issued Feb. 13, 1979, for example, which further shows a corresponding pressure/flow-rate diagram containing a pumping-limit and blowoff line as well as performance curves of turbocompressors. One skilled in the art will generally be familiar with these terms.

When the load on the machines is asymmetric, the deviation of one of the machines, $x_d(A)$, differs from that of the other machine, $x_d(B)$. The difference between these two quantities is obtained at a difference junction 22 and fed as a correcting quantity $x_d(A)-x_d(B)$ (actual value) to the two load-distribution controllers 18a, 18b, with different signs obtained by an inverter 24 in the path to controller 18b. The desired difference value from the difference junction 22 via the pumping-limit controllers 20a, 20b usually is zero; however, it can also assume other values if asymmetry is desired.

The output of the load-distribution controllers 18a, 18b acts additively in summing junctions 26a, 26b with the output of the pressure controllers 14a, 14b. With different loads on the machines, one of the load-distribution controllers 18a, 18b thus opens the respectively-associated throttle valve 16a, 16b farther while the other closes the throttle valve of the parallel-connected machine or machines by the same amount. Assuming that the throttle valves 16a, 16b have a linear characteristic, this control action will not affect the overall flow rate of the machines, and hence the final pressure. In an actual installation, the pressure controllers 14a, 14b correct the asymmetries of the throttle valves 16a, 16b to maintain the overall flow rate at outlet 12.

As a result, the pressure controllers 14a, 14b and load-distribution controllers 18a, 18b are decoupled and both may therefore be given the same transient response. When the final pressure at outlet 12 changes, only the automatically-adjusting pressure controller 14a follows to adjust the machine A which is set for automatic operation. The resulting asymmetry in the machine loading is detected by the load-distribution controllers 18a, 18b, which then adjusts both (all) machines until symmetry is reestablished.

With the compressors in operation, the respective pressure-controller and load-distribution controller outputs are added, as is apparent from FIG. 2. The sum, that is to say, the input to the throttle valves 10a, 10b, can therefore assume values ranging from 0 to 200 percent of the rated value. Since the extreme position of the throttle valve is reached already at 100 percent, considerable overdriving may occur. This is undesirable and may result in serious operating troubles.

Figure 3:
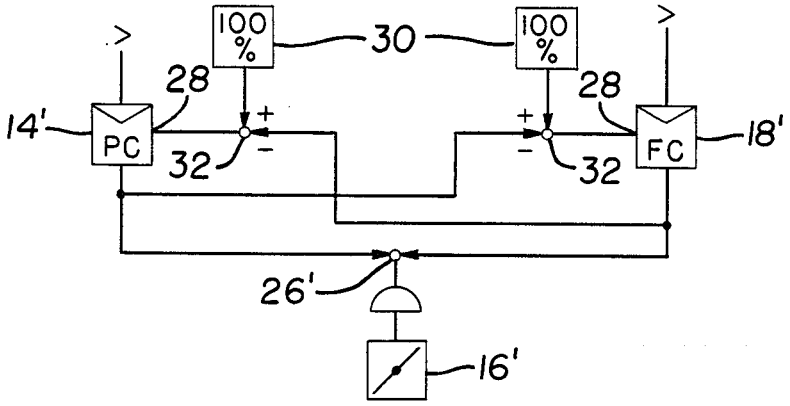
FIG. 3 shows another, slave, load-distribution control circuit in accordance with the invention for limiting the controller outputs.

To prevent this, a circuit in accordance with FIG. 3 may be used for each throttle valve 16'(only one shown). Pressure and load-distribution controllers 14', 18' have their outputs limited to a valve that can be set externally at ports 28. Overdriving is prevented by limiting the output of each controller 14', 18' via difference junctions 32 connected to the ports 28 to a valve equal to the difference between the other controller output (to summing junction 26') and 100 percent of the permissible input to throttle valve 16' (i.e., its response limit) and a fixed; 100% output of devices 30.

Another possibility is to prevent the further rise of the inputs to the pressure and load distribution controllers whenever the throttle valve controlled thereby has reached its extreme position. Technically, this can be accomplished either through appropriate wiring of the controllers or, as shown in the circuit diagram of FIG. 4, through maximum selection ahead of each controller.

Figure 4:
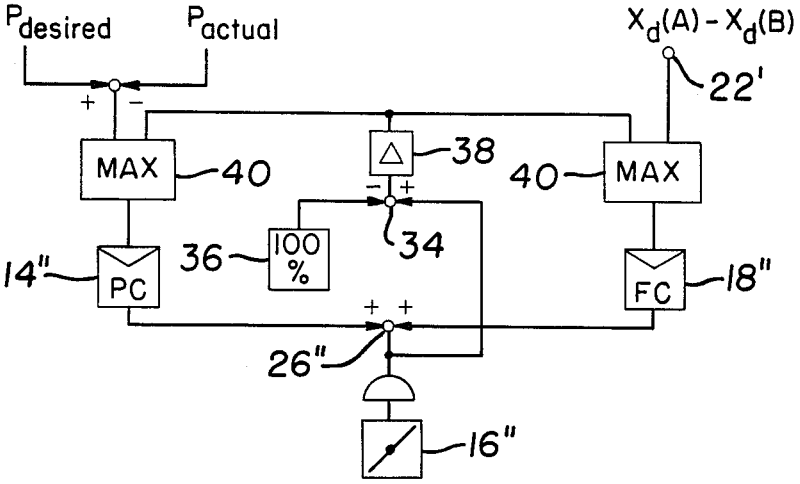
FIG. 4 shows another, extreme-position, limiting load-distribution control circuit in accordance with the invention.

In FIG. 4, the outputs of pressure and load-distribution controllers 14'', 18'' for each compressor machine are, as before, fed through the summing junction 26'' to the throttle valve 16'' in the compressor flow path. The throttle valve control signal from summing junction 26'' is also fed, however, to a difference junction 34 where it is compared with a fixed output of device 36 equal to 100% of the permissible throttle valve control signal. To secure adequate controller dynamics even with final-control-element inputs close to 100 percent without unduly limiting the deviations for the pressure and load-distribution controllers, an amplifier 38 amplifies the difference from junction 34. The amplified difference is then fed to maximum-value selection devices 40 which block any increase in the respective control signals to the pressure and load-distribution controllers 14'', 18'' when the output of amplifier 38 reaches a zero threshold.

The same function can be obtained in alternative embodiments (not shown) by applying to the maximum-selection devices a value of zero when the extreme throttle valve position is reached as indicated by a limit switch (not shown) or a limiting value is reached in the sum of the final-control-element input to the throttle values while in all other case the maximum-selection devices pass all of the applied correcting quantity signal.

Figure 5:
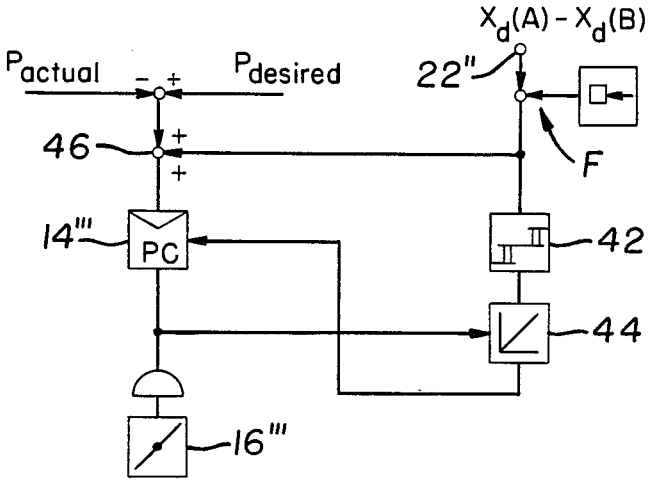
FIG. 5 shows another load-distribution control circuit in the form of a step controller.

In a basically different approach, the load-distribution controller may take the form of a three-step controller in accordance with the circuit diagram of FIG. 5. When the correcting quantity $x_d(A)-x_d(B)$ from junction 22'' overshoots (exceeds) the switching threshold of a step controller 42, a connected integrator 44 is shifted in the proper direction until the threshold is again undershot.

At the same time, the correcting quantity from junction 22'' is added in summing junction 46 to a pressure-deviation input for the pressure controller 14'''. The output of the pressure controller is applied to the throttle valve 16''' and also applied to the slave input of integrator 44. The output of the integrator 44 is fed back to the slave input of the pressure controller 14'''.

If the pressure controller is set for automatic operation (like pressure controller **14*a*), the correcting quantity acts through controller 14''' on the throttle valve. The pressure controller shifts its output signal until both the pressure deviation and the flow-correcting quantity are zero. The integrator is simultaneously set for slaving. The step controller 42** is thus inoperative, and the integrator follows the pressure-controller output without delay.

When the pressure controller 14''' is cut out, i.e., the signals summed at junction 46 are zero, however, its output is slaved to the integrator output. The integrator is now positioned by the step controller 42, however, which thus has a direct influence on the throttle-valve position.

Any changeover will be free of jumps since only the controller 14''' or the integrator 44 is in operative control at a given time and the one which is not controlling is slaved to the output of the other. This also prevents overdriving.

If both controllers are to be set for manual operation, it will suffice just to have the pressure controller 14''' responsive to manual operation. The throttle-valve position then is preset only by hand.

If the pressure controller is to be set for automatic operation and the load-distribution controller for manual operation, however the correcting quantity from junction 22'' must be set to zero through a control action.

The transient response of the load-distribution controller can be set either by means of a clock at the output of the step controller 42 or through an adjustable time constant of the integrator.

In place of a step controller, two limit-value stages may be used.

Asymmetry may be secured by the addition of a fixed value to the correcting quantity as at F.

The method in accordance with the invention described above is applicable also when more than two turbocompressor machines have been installed. When only two out of several machines are to be operated at a time, it is merely necessary to provide, through a selection logic circuit, that the correcting quantity $x_d(A)-x_d(B)$ is the difference between the pressure and flow deviations of the two machines in operation. A diagram for this in the case of three installed machines is given in FIG. 6.

Figure 6:
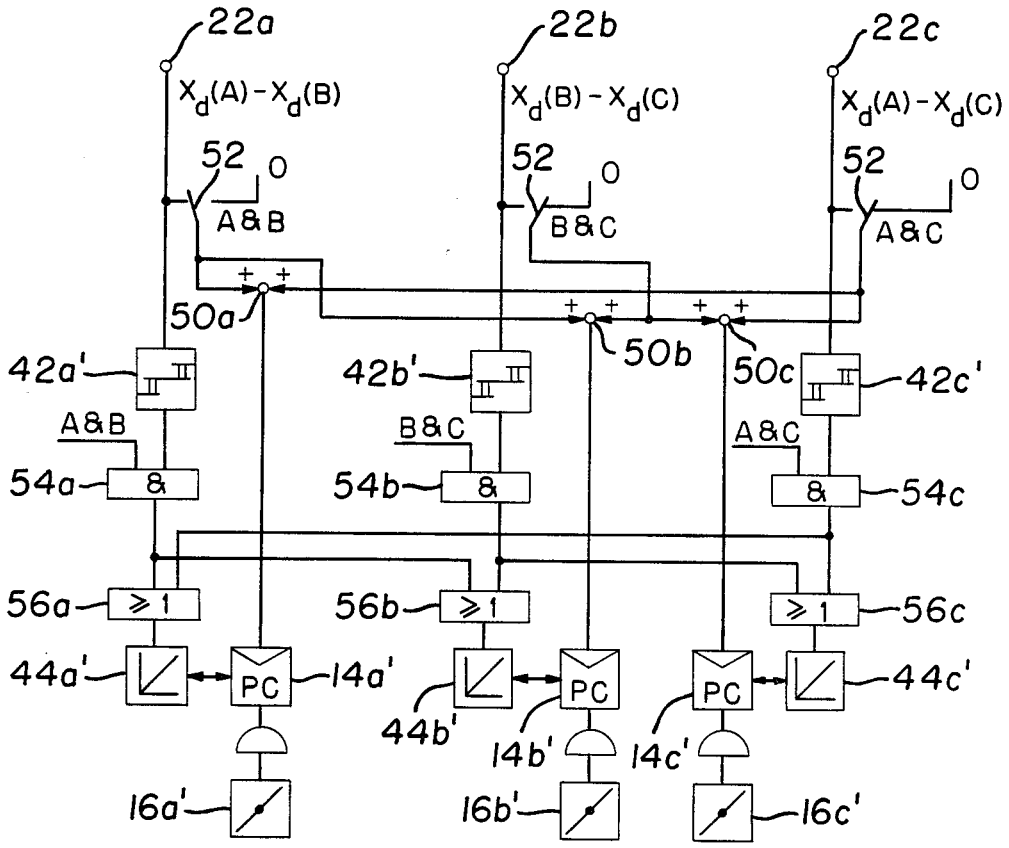
FIG. 6 shows another load-distribution control circuit in accordance with the invention like that of FIG. 5, but for the parallel operation of two out of three machines.

Correcting quantities are formed for every possible combination of machines: $x_d(A)-x_d(B)$, $x_d(B)-x_d(C)$, and $x_d(A)-x_d(C)$. For each machine there are two combinations, so that two correcting quantities are applied to each pressure controller **14*a'*, 14*b'*, 14*c* through summing junctions 50*a*, 50*b*, 50*c*, respectively. The selection logic circuit must reduce the correcting quantities of all improper combinations to zero with changeover switches 52 A&B, 52 B&C and 52 A&C. The correcting quantity of the machine combination selected, A&B in FIG. 6, is fed in parallel to the two associated pressure controllers 14*a'*, 14*b'***. The pressure controllers must be interlocked to assure that only one of them can be set for automatic operation at a time.

For this, the inputs of the load-distribution controllers of the form in FIG. 5 are inhibited from improper combinations through logic AND gates **54*a*, 54*b*, 54*c* and OR gates 56*a*, 56*b*, 56*c*** which pass an appropriate logic signal only for the selected one of the indicated combinations A&B, B&C, and A&C, A&B in this example.

It is possible, of course, to dispense with these logic gates and to take off the input signal to the step controller **42*a'*, 42*b'*, 42*c'* from the changeover switches 52. However, this has the disadvantage that the opened switches 52 B&C, 52 A&C must have no residual voltage as otherwise the integrators 44*a'*, 44*b'*, 44*c'*** might be affected.

The changeover/logic arrangement also may be dispensed with altogether (in another embodiment not shown) if it is possible to decide during the design stage which of the two machines which will be in operation at any given time is to control the pressure and which is to be slaved. In this case, it is only necessary to apply the appropriate analog correcting quantity to the corresponding controller.

It is conceivable, for example, that in the combinations A&B, B&C and C&A, the first controls the pressure. Then, as before, the correcting quantities for all conceivable combinations of two machines are formed first. The combinations with inoperative machines which are improper for the predetermined configuration are reduced to zero. The pressure controller of each machine is fed all correcting quantities in which the deviation of that machine occurs, added with the proper sign.

Since the average values of all correcting quantities are always zero, the formation of a weighted average based on the particular machine thus results.

The same procedure is followed with respect to the inputs of the load-distribution controllers (not shown). A step controller is associated with each correcting quantity. In its outputs, all combinations with inoperative machines are inhibited.

The output of each step controller is applied in parallel to the integrators of the two machines the deviation of which is contained in the correcting quantity. In the case of the step-controller outputs, too, the number of adjusting commands is exactly the same in the direction of ascending adjusting commands as in that of descending ones. Here, too, then, an average is formed which results in precisely the desired adjusting pattern.

Figure 7:
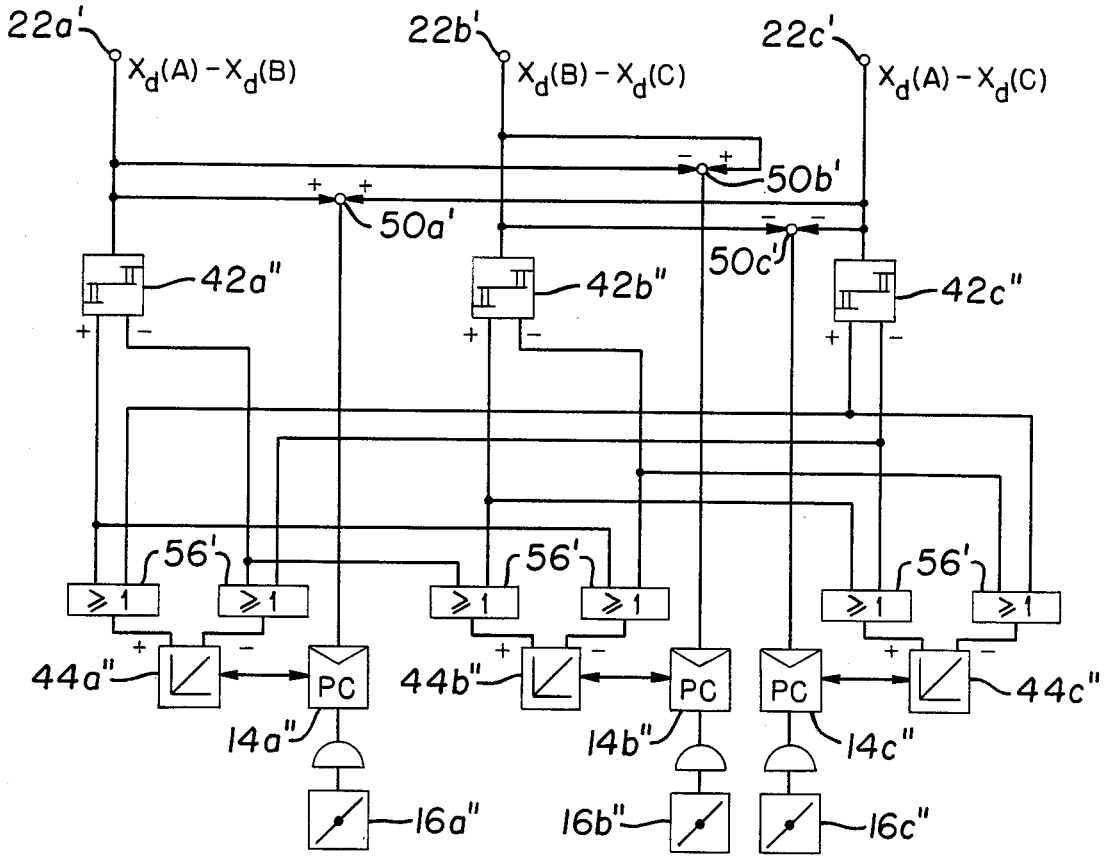
FIG. 7 shows another load-distribution control circuit like that of FIG. 6, but for the simultaneous parallel operation of three machines.

Shown in FIG. 7 is a circuit diagram for the operation of three machines wherein the selection circuit (52 in FIG. 6) and other, inoperative machines are not shown. A specific example will illustrate its structure and operation.

The following operating point is assumed:

$$x_d(A)=50\%,\ x_d(B)=40\%,\ x_d(C)=30\%.$$

Pressure controller (PC) **14*a''*** thus receives as correcting quantity $$(x_d(A)-x_d(B))+(x_d(A)-x_d(C))=30\%,$$

pressure controller **14*b''*** receives $$-(x_d(A)-x_d(B))+(x_d(B)-x_d(C))=0\%,$$

and pressure controller 14c''

$$-(x_d(B)-x_d(C))=(x_d(A)-x_d(C))=-30\%,$$

respectively from the indicated junctions 50a', 50b', 50c'.

The respectively-associated integrator 44a'' receives a + command, and integrator 44c'' a—command from oppositely-signed outputs of step controllers 42a'', 42b'', 42c'' and gates 56' in the indicated circuit.

The commands to integrator 44b'' cancel each other out, and the throttle valve 16b'' of machine B therefore is not re-positioned. Load distribution is effected by re-positioned the throttle valves 16a'', 16c'' of machine A and machine C.

It goes without saying that only one machine must be pressure controlled even when three machines are operated in parallel. What has been said about the operation of two machines applies also to the parallel operation of three machines.

With appropriately expanded circuitry, this method lends itself to use also with more than three machines.

The method is further suited for use when multistage machines with intermediate injection are parallel-connected and load distribution is required for every stage.

Figure 8:
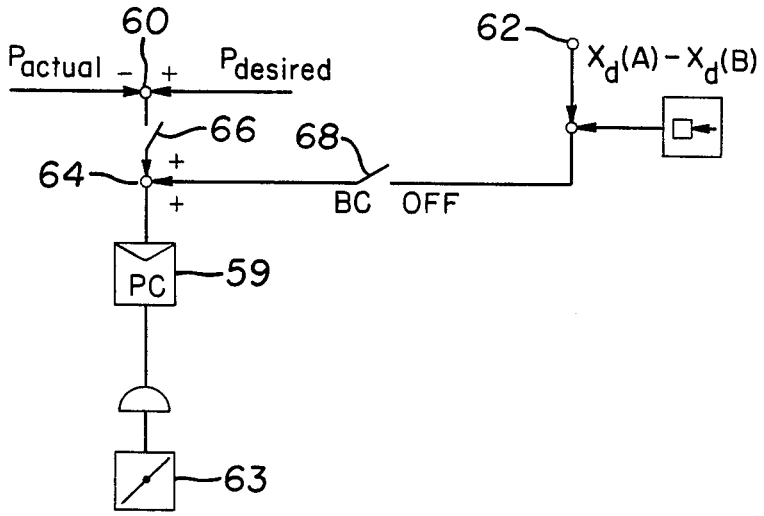
FIG. 8 shows another load-distribution control circuit with a single pressure controller.
Figure 9:
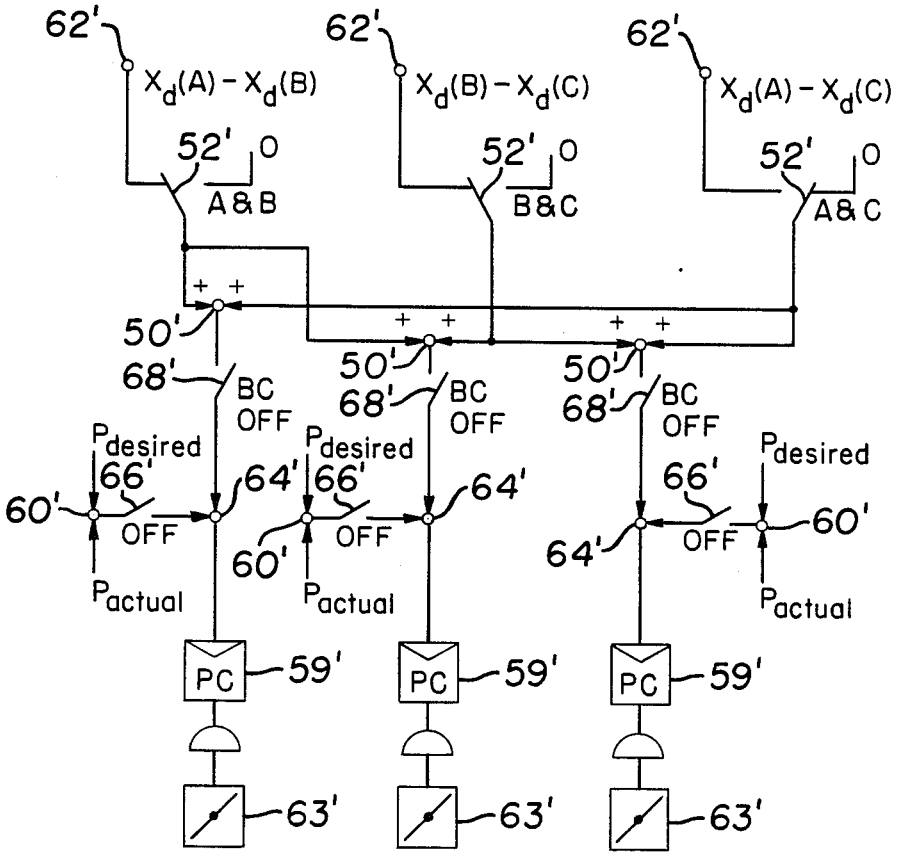
FIG. 9 shows another load-distribution control circuit like that of FIG. 8, but for the parallel operation of two out of three compressors.
Figure 10:
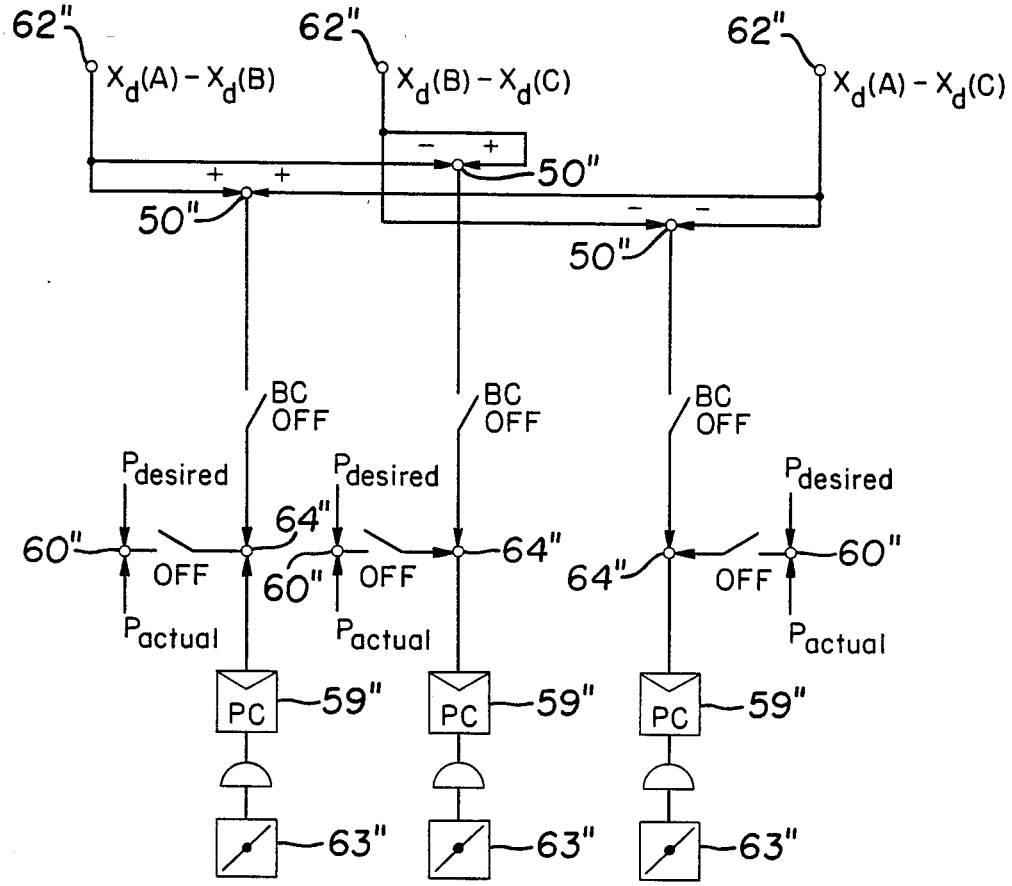
FIG. 10 shows another load-distribution control circuit like that of FIG. 8, but for the parallel operation of three compressors.

FIGS. 8 to 10 show much simpler circuits than those of FIGS. 5 to 7 which are, therefore, most preferred. In these, a "pressure control" deviation signal , that is to say, the desired value of the pressure minus the actual value of the pressure, and a load-distribution or balance control (correcting quantity) deviation signal are formed for each pressure controller 59 in difference junctions 60, 62, respectively. These contain all correcting quantities necessary for positioning the throttle valve 63 as required. When the pressure and load-distribution controls are cut in, these signals are added in summing junctions 64 and adjustment of the pressure controllers proceeds until the sum of all deviations is zero. When a pressure or load-distribution control is to be cut out, the corresponding input quantity is reduced to zero through a respectively-associated changeover contact 66, 68. During such a changeover, the pressure controller is momentarily set for manual operation.

Manual intervention takes place through a manual adjustment input (not shown) on the pressure controller 59. Through an interlock (not shown), provision must be made for the balance controls 62 of all parallel-operated machines, for example the two of three or three of three of FIGS. 9 and 10, to be cut in jointly every time. Otherwise there might be operating cases where the deviation of the operative pressure controller 59 is of the same amount as the deviation of the balance control 62, but of a different sign. When only one balance control 62 is in operation, this might result in a simulated or negated quasi-adjustment. If the parallel load-distribution controller (whose pressure controller must be cut out, as will be recalled) is also operative, however compensation will result along with release from such quasi-adjustment.

It is apparent that the control system in accordance with the invention makes possible the improved and, in particular, more reliable operation of two or an even larger number of turbocompressors without requiring a great many elaborate controlling means. Thus it may be said to represent an ideal solution for the problems involved.

What is claimed is:

1. A method of operating at least two parallel-connected, controllably-adjustable turbocompressors each having a blowoff or blowdown valve for opening before a pumping limit is reached at a blowoff line extending parallel to the pumping limit for the prevention of surge, comprising: controlling the turbocompressors jointly by load-distribution controllers and individually by pressure controllers, the load-distribution controllers adjusting the individual turbocompressors in such a way that the spacing of the operating point from the blowoff line is the same for each of them.

2. A method according to claim 1, wherein only one of the turbocompressors is adjustably controlled by its pressure controller and that the others are slaved to the load-distribution controllers.

3. A method according to claim 2, wherein the pressure controller which adjustably controls its turbocompressor responds automatically to the pressure therefrom while the pressure controllers of the other turbocompressors are set manually.

4. A method according to claim 1, wherein controlling the turbocompressors comprises forming a pressure-control deviation and a load-distribution control deviation; adding these deviations; and adjusting the turbocompressors until the sum of the deviations is zero.

5. A method according to claim 1 for compressors with several pressure stages, characterized by its being employed in every pressure stage.

6. A method according to claim 1 for double-flow compressors, characterized by its being employed for each partial flow.

7. Apparatus for operating at least two parallel-connected, controllably-adjustable turbocompressors each having a blowoff or blowdown valve for opening at a blowoff line extending parallel to a pumping limit before the pumping limit is reached, comprising:

a pressure controller for each turbocompressor; and load-distribution controller means for jointly controlling the turbocompressors comprising a pumping-limit controller for each turbocompressor and responsive to its operation for determining the spacing of the operating point of the turbocompressor from its blowoff line and means responsive to the determined spacings for adjusting the control of the turbocompressors such that the spacing of the operating point from the blowoff line is the same for each operating turbocompressor.

8. The apparatus of claim 7, wherein the pressure controller for one turbocompressor comprises means for response to the pressure therefrom and the pressure controller for each other turbocompressor comprises passive means for manual setting.

9. The apparatus of claim 7, wherein the means responsive to the determined spacings of the operating point of each turbocompressor from its blowoff line comprises difference junction means for combining the same as a correcting quantity for each combination of pairs of the turbocompressors and opposite-adjusting means responsive thereto for oppositely adjusting the control of one pair of every three of the turbocompressors such that the spacing of the operating point from the blowoff line is the same for each operating turbocompressor.

10. The apparatus of claim 9 wherein the opposite-adjusting means comprises an inverter.

11. The apparatus of claim 9 wherein the opposite-adjusting means comprises logic devices.

12. The apparatus of claim 9 wherein the opposite-adjusting means comprises appropriately selected summing and difference junctions.

13. Apparatus for operating at least two parallel-connected, controllably-adjustable turbocompressors each having a blowoff or blowdown valve for opening at a blowoff line extending parallel to a pumping limit before the pumping limit is reached, comprising:

a pumping limit controller for each turbocompressor and responsive to its operation for determining the spacing of the operating point of the turbocompressor from its blowoff line;

a difference junction for combining the determined spacing of the operating point from the blowoff line of each pair combination of the turbocompressors as a correcting quantity;

load-distribution controller means responsive to the correcting quantity of one pair of each three turbocompressors for oppositely controlling the pair thereof such that the spacing of the operating point from the blowoff line is the same for each operating turbocompressor;

a pressure controller for each turbocompressor;

a difference junction for response to desired and actual pressure valves for each turbocompressor; and switch and summing junction means for adding the difference junction pressure value to the control of only one turbocompressor to the load-distribution controller means.

* * * * *